United States Patent [19]

Stout

[11] 3,977,960

[45] Aug. 31, 1976

[54] HYDROCARBON RECOVERY SYSTEM

[76] Inventor: Vincent H. Stout, 1003 Sierra Drive, Riverton, Wyo. 82501

[22] Filed: Jan. 3, 1975

[21] Appl. No.: 538,274

[52] U.S. Cl. ..... 208/11 R; 208/8; 201/10; 201/11; 202/219

[51] Int. Cl.[2] ..... C10G 1/02; C10B 47/14; C10B 1/06

[58] Field of Search ..... 208/9, 10, 11, 8; 201/10, 11; 202/219; 203/100; 48/92

[56] References Cited

UNITED STATES PATENTS

| | | | |
|---|---|---|---|
| 1,601,777 | 10/1926 | Spotz | 201/11 |
| 1,681,808 | 8/1928 | Morgan | 201/11 |
| 2,459,550 | 1/1949 | Stamm | 201/11 |
| 2,700,018 | 1/1955 | Gilbert | 201/11 |
| 2,768,935 | 10/1956 | Watkins | 208/8 |
| 2,787,584 | 4/1957 | Farafonow | 202/219 |
| 3,668,109 | 6/1972 | Kiovsky et al. | 208/10 |
| 3,708,270 | 1/1973 | Birk et al. | 48/202 |
| 3,736,250 | 5/1973 | Berg et al. | 208/10 |
| 3,770,419 | 11/1973 | Brown | 201/11 |
| 3,847,797 | 11/1974 | Pasternak et al. | 48/202 |

*Primary Examiner*—Delbert E. Gantz
*Assistant Examiner*—James W. Hellwege
*Attorney, Agent, or Firm*—Beveridge, DeGrandi, Kline & Lunsford

[57] ABSTRACT

A system for the recovery of the vaporizable constituents of a particulate, hydrocarbon-containing composite. A suitable source material is continuously conveyed into the system through an air entry prevention means and submitted to at least one heating by a molten heat transfer material contained in a chamber surrounding the conveyor transporting the particulate composite. The vaporized products released from the particulate composite, when heated, are collected in at least one products recovery means and are condensed and separated into respective gaseous and liquid components. The particulate composite is then conveyed from the molten heat transfer liquid which is also an exit air seal, cooled, and then discarded in a conventional member.

18 Claims, 3 Drawing Figures

HYDROCARBON RECOVERY SYSTEM

BACKGROUND OF THE INVENTION

This invention relates to an improved method and apparatus for separating the vaporizable hydrocarbon-containing constituents from a particulate composite. More particularly, this invention relates to a novel means to remove the vaporizable constituents from a particulate composite wherein the particulate composite is intimately comingled within a molten heat transfer material having a melting point below, and boiling point above the vaporization temperature of constituents to be recovered.

Certain apparatus for the retorting of oil shale, coal, or tar sands is well-known. In a conventional apparatus, crushed oil-bearing shale or the like is carried into a kiln or retort where the ore is heated and the kerogen products are driven off and collected. for example, U.S. Pat. No. 3,325,395 discloses a method for the recovery of oil from travelling oil-bearing shales and sands. The crushed ore is continuously conveyed through two heating zones in the apparatus in an effort to remove the hydrocarbonaceous materials therein. In another mode, U.S. Pat. No. 3,546,092 discloses an oil shale retorting method and apparatus where the crushed ore is admitted to the top of a vertical retort, and the released kerogen products recovered near the top of the retort. Also, U.S. Pat. No. 2,459,550 passes organic material through a liquid bath, the organic material being separated from the liquid bath by screens which allow the transfer of heat to the material.

Heretofore, it has been recognized that the oil shale ore, after being retorted in accordance with prior art apparatus, has contained a significant amount of hydrocarbon products which have not been recovered. With the present world-wide realization that energy resources are limited in amount and rapidly dwindling, it has become increasingly evident that new and more efficient means, as well as a more complete means of recovery of hydrocarbons from oil-bearing material must be found and practiced.

Previous apparatus has been unable to economically and completely remove all the oil and hydrocarbon constituents of shale rock or the like in part because previous retorts have been unable to rapidly and effectively transfer heat to the shale rock. The overall rate of heat transfer has been so low and inefficient in prior art apparatus as to render them economically non-competitive with drilled recovery of petroleum.

Additionally, prior proposed forms of continuously conveying apparatus have allowed air to be introduced into the retorting chamber. The recovered constituents therefore have the undesirable feature of dilution with nitrogen. Also, presence of oxygen in the combustible gas tends toward fire and explosion hazards.

SUMMARY OF THE INVENTION

The present invention comprises a method and apparatus for the recovery of hydrocarbon products from a particulate composite in which the undesirable aspects of the prior art have been eliminated. Crushed oil shale, or the like, at ambient temperature, is conveyed into the system through an initial air sealing means, thence to a first collection chamber. The first chamber may have apparatus to heat the crushed ore. Any products vaporized from the particulate composite are collected in the first collection chamber as the particulate composite is conveyed toward a second collection chamber. The second collection chamber contains a liquid metal or salt which is maintained at a temperature above the vaporizing temperature of the vaporizable constituents of the particulate composite. The particulate composite is then conveyed from the second collection chamber as the vaporized parts are collected, and transmitted through an exit sealing means which prevents entry of air into the recovery chambers. The spent particulate composite is then preferably conveyed into a recovery apparatus for recovering any metal or salt and then discarded. The vaporized products may be recovered in any known manner.

It is therefore a primary object of the present invention to more completely recover the vaporizable constituents of a particulate composite by comingling the particulate composite with a molten heat transfer material.

It is yet a further object of the present invention to recover the vaporizable constituents of a continuously moving particulate composite in the absence of air.

These and other objects and advantages of the invention will become apparent during the following detailed description, taken in connection with the accompanying drawings, and in which

DRAWINGS

FIG. 1 is a detailed block diagram of the system as envisioned in the present invention, according to a preferred mode, FIG. 2 is a detailed drawing of one embodiment of an initial air sealing means included in FIG. 1, and FIG. 3 is a detailed drawing of the portion of the system of FIG. 1 containing the molten heat transfer material.

DETAILED DESCRIPTION OF THE INVENTION

Figure 1:
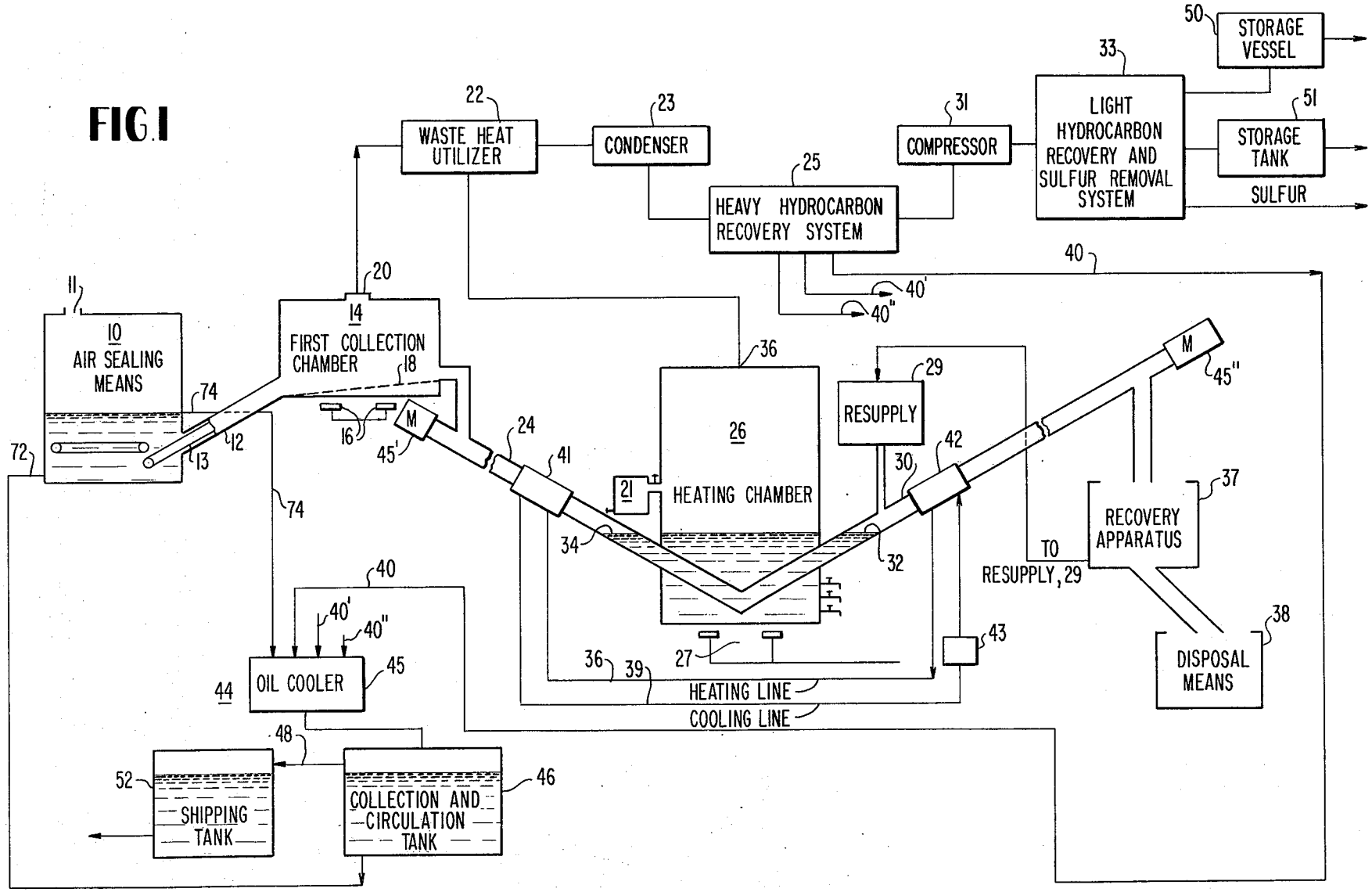

FIG. 1 illustrates, in block form, essential components of the present invention including optional components for a preferred method and apparatus. A sealing means 10, shown in more detail in FIG. 2, accepts the hydrocarbon-containing particulate composite at entry 11 and prevents air from entering the system. The particulate composite is conveyed from the air sealing means 10 via conveyor 13 contained in closed conduit 12, and transmitted through a first collection chamber 14.

First collection chamber 14, which also may include optional heating means 16, is similar in design to prior art oil retort and hydrocarbon products collection apparatus except for an air seal hereafter described, and continuous conveyance and recovery modifications. Heating means 16 may be any suitable apparatus which can heat the composite to desired temperatures. A sloped floor 18 allows any liquid products released from or clinging to the particulate composite to drain back down closed conduit 12 to sealing means 10. In addition, gaseous products are collected via collector 20 and transmitted to a hydrocarbon recovery system. When heating means 16 is employed, a major portion of the gaseous products may exit via collector 20. The particulate composite is then conveyed from chamber 14 via conveyor 24 to a retort chamber 26 containing molten heat transfer material 28. Molten sodium chloride, or other chlorides, sulfides, etc., which are inexpensive and non-reactive with the ore may be employed, or, alternatively, molten lead, aluminum, metal alloys, etc., may be utilized.

As can be seen in the drawings, molten heat transfer material 28 extends a short distance up conveyor 24, as well as extending a short distance up spent ore disposal conveyor 30. Conveyors 24 and 30 can be any suitable means for the transportations of the composite. As shown most clearly in FIG. 3, conveyors 24 and 30 are screw conveyors driven by motors 45' and 45'', respectively. However, any suitable type of conveyor, such as an endless train of ore-carrying cars, can be employed. Heating means 27, of any suitable type, and resupply means 29 for material 28 are shown schematically. Since the molten heat transfer material completely fills that portion of conveyor 30 in which it is located to a point above the exit port of chamber 26, an air seal is effected at surface 32, thereby preventing any air from entering chamber 26 by way of the spent ore disposal conveyor 30.

When entering molten heat transfer material 28 at surface 34, some of the vaporizable constituents of the particulate composite are released and travel up conveyor 24 and are collected in first collection chamber 14. Also, as the particulate composite is conveyed through the molten heat transfer material, further vaporizable constituents are released, and the vaporized products are collected at the top of chamber 26 through collection port and conduit means 36. Any ash collecting in chamber 26 may be removed by ash removal means 21. The vaporized products collected in collection means 36 are joined with the vaporized products collected in collection means 20. The hot vapors may be passed through a waste heat utilizer 22 where steam may be produced for generation of electricity. Heavy hydrocarbons are removed by condensor 23 and passed through heavy hydrocarbon recovery system 25. Lighter hydrocarbons pass into compressor 31 where they are compressed prior to introduction into light hydrocarbon recovery and sulfur removal system 33. All recovery apparatus is well-known and not part of this invention.

The spent particulate material is continuously removed from chamber 26 via conveyor 30, and preferably subjected to a metal or salt recovery apparatus 37. Apparatus 37 may consist of an open bottom centrifuge vessel through which the spent hydrocarbon materials pass, and the clinging metals or salts centrifugally removed while still at elevated temperature and returned to the molten bath. Disposal means shown generally at 38 may include an exit port and conveyor and/or disposal pit for storage of spent ore.

Preferably, in combination with the second chamber 26, a heat exchange apparatus comprising preheating means 41 and cooling means 42 are employed in the present invention. Particulate composite in conveying means 24 is subjected to heating in supplemental or preheating means 41, while the spent particulate composite leaving chamber 26 by conveyor 30 is partially cooled by cooling means 42, with cooling not sufficient to cause any molten material clinging to the particulate composite to solidify. A further cooling means 43 may be employed to maintain cooling means 42 at a desired temperature. Heat is transferred between 41 and 42 via heating line 36 and cooling line 39.

Light hydrocarbon products from hydrocarbon recovery system 33 can be stored in vessel 50 for later shipping, sales, or could be used as plant fuel. Less volatile liquids, as, for example, gasoline, may be contained in one or more storage tanks 51 for later shipping or employed in tanks 46 or 52 to reduce heavy oil viscosity.

Any heavy liquid hydrocarbon products recovered from heavy hydrocarbon recovery system 25 can be sent via pipes 40, 40', 40'', etc. to storage and shipping system 44. The liquid products are cooled in oil cooler 45 when cooling is necessary. and then directed to a collection and circulation tank 46. When tank 46 is filled, the liquid products flow through overflow 48 to storage and shipping tank 52. The liquid products may then be shipped to a refinery, or refined in apparatus contiguous to the oil recovery system.

Figure 2:
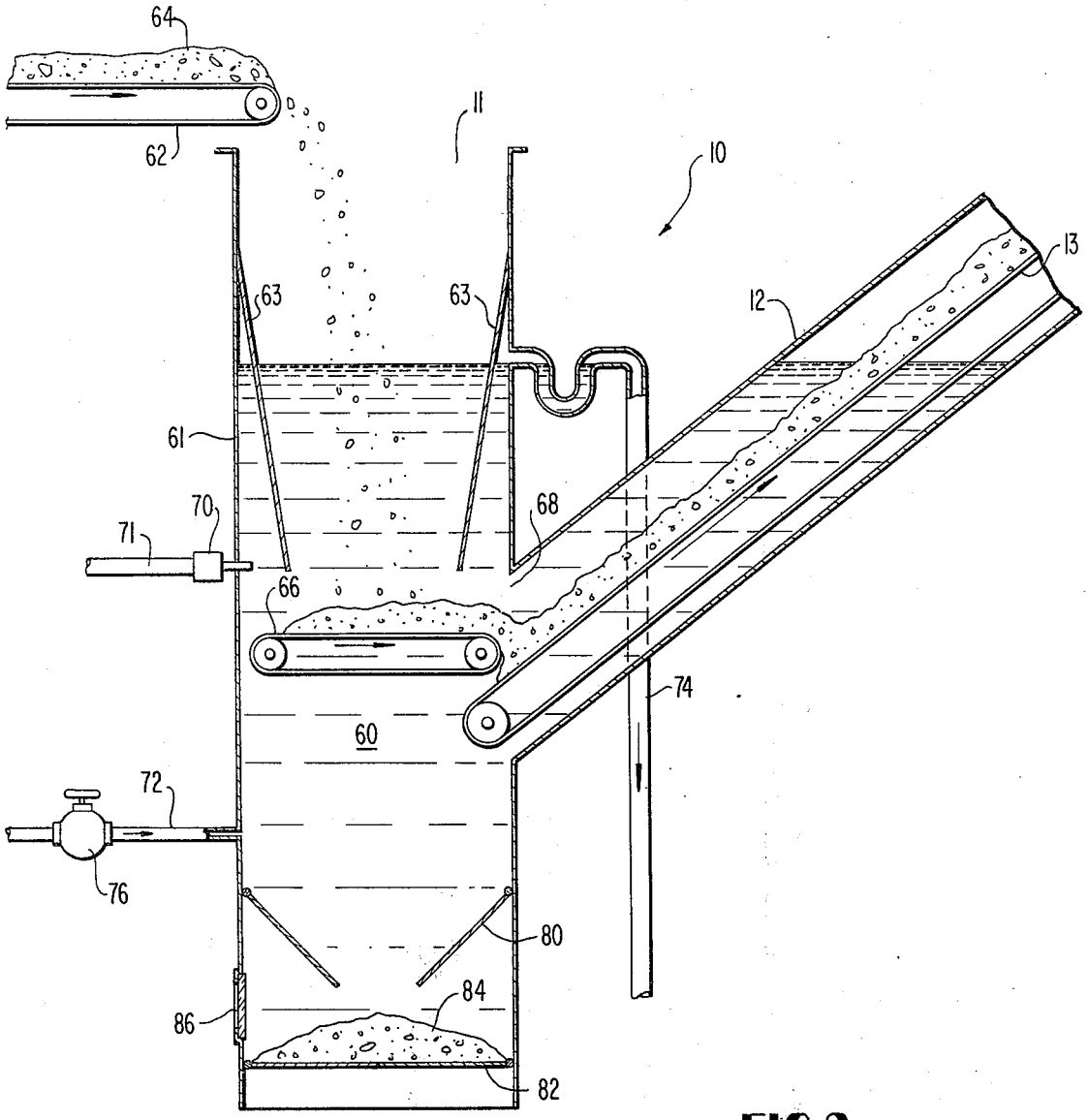

Turning now to FIG. 2, one form of air sealing means 10 is shown in greater detail. Air sealing means 10 consists of a vessel 61 partially filled to a predetermined level with liquid 60. Liquid 60 can be any suitable liquid which prevents air from travelling with the particulate composite after it passes from liquid 60. Recovered oil, or water, if available, could be employed, as well as low melting point metals, salts, etc. Conveyor 62, or any like means, introduces particulate composite 64 into liquid 60, the falling material being directed by guides 63. A first conveyor 66 (driving motor not shown), catches the falling particulate material and transmits it to conveying means 13, in closed conduit 12, with which the particulate composite is transported above the level of sealing liquid 60. As port 68 is located below the surface of liquid 60, no air can therefore travel with the particulate composite as it proceeds on further into the system.

To prevent the liquid 60 from being reduced to a level low enough to allow air to enter the system, low level detection means 70 is employed to detect when the level of liquid 60 approaches the leakage level. Low level detection means 70 can be employed to transmit signals via wires 71 to an operator to advise him of such a dangerous condition, or can automatically turn on the supply or shut down the system according to conventional control means not part of this invention.

To be assured of an adequate level of liquid 60 in vessel 61, liquid 60 may be constantly circulated from an appropriate circulation tank, as at 46, and may enter vessel 61 via pipe 72 and exit via pipe 74. Valve means 76 may control the flow of liquid 60 throughout the recirculating system, and a level control (not shown) employed to assure a level of liquid 60 commensurate with the opening of exit pipe 74 in vessel 61.

To allow for recovery of any spillage of particulate composite from conveyor 66, which would be constructed to assure minimal spillage, normally open means 80 and normally closed means 82 can be employed. Particulate composite which falls from conveyor 66 collects in a mass 84 on normally closed means 82. A window 86 can be employed to physically view the collection 84, or a suitable remotely-activated detection means can be employed. When collection 84 is of a sufficient depth to warrant its removal, normally open means 80 is closed, and normally closed means 82 is opened for removal of mass 84, 82 is then closed, the air displaced, and 80 opened to allow collection to proceed in a like manner. Any portion of liquid 60 which is removed with collection 84 will be continuously replaced through pipe 72.

Figure 3:
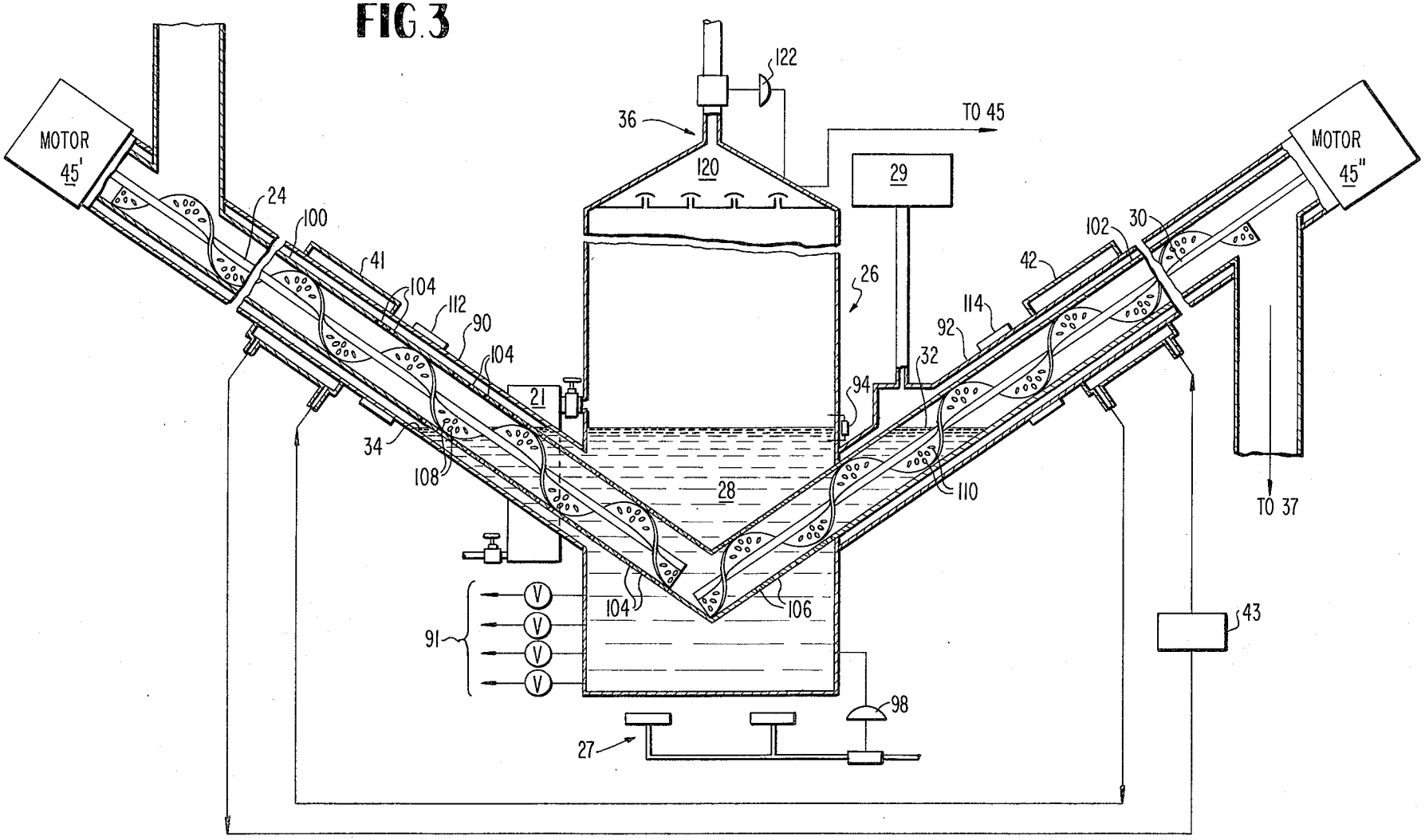

Chamber 26 and one embodiment of its associated apparatus are shown in greater detail in FIG. 3. Molten heat transfer material 28 is contained in chamber 26 and maintained at a predetermined depth therein, heat transfer material 28 also rising to a natural level within conduits 90 and 92. A detecting device 94, e.g. a pressure differential or level detector, is employed to assure that a sufficient quantity of molten heat transfer material 28 is contained within chamber 26 at all times. Resupply 29 supplies molten heat transfer material 28 to chamber 26. Valves 91 are employed as outlets to drain varying specific gravity material in 28 from chamber 26.

To assure that molten heat transfer material 28 is maintained at a sufficiently high termperature, a heating means shown schematically at 27 is employed beneath chamber 26. A temperature responsive control 98 may be used to regulate the flow of fuel to heating means 27 according to preset limits, or control the heat or heating means 27 if another type of heating source is employed.

Each conveyor 24 and 30 is contained within a sleeve 100 and 102, respectively. Sleeve 100 is provided with a plurality of holes or perforations 104, and sleeve 102 is provided with a plurality of holes or perforations 106. Holes or perforations 106 extend only a short distance up sleeve 102 as shown since no further hydrocarbons remain to be removed from the composite. All holes or perforations would be smaller than the size of the smallest normal particles of the crushed particulate composite. Additionally, conveyor 24 may be perforated with holes 108 and conveyor 30 may be perforated with holes 110. Beveled holes may be employed to be non-clogging. Air tight expansion joint 112 is provided on conduit 90 to allow for expansion of the conduit due to heating without allowing air to enter the system, while expansion joint 114 is provided on conduit 92.

When the particulate composite is conveyed down conveyor 24, it strikes molten heat transfer material 28 at surface 34 and thereat releases a large portion of its vaporizable constituents. These constituents travel back up sleeve 100, flowing through holes 104 and being guided by conduit 90 up to first collection chamber 14 (FIG. 1). Sleeve 100 and conduit 90 are spaced sufficiently to allow released vapors to readily flow to chamber 14, as well as to allow heat transfer material 28 to freely flow up to surface 34 and pass through perforations 104. Vaporizable constituents later released while particulate material passes through chamber 26 rise in chamber 26, flowing through collection means 36. Any vaporized constituents which condense in the upper part of chamber 26 are collected in collector pan 120 and conveyed to a collection tank (not shown). To maintain a sufficient pressure in chamber 26, back pressure regulator 122 is utilized. The escaping vaporized products which then flow through collection means 36 are transmitted to hydrocarbon recovery systems 25 and 33.

The hydrocarbon recovery system can be one of several commonly employed condensate recovery devices. For example, vaporized products which enter the hydrocarbon recovery system may first pass through a waste heat utilizer 22 to utilize the heat from the vaporized products to produce, for example, electricity. Thereafter, any gases not condensed in waste heat utilizer 22 and recovered in heavy hydrocarbon recovery system 25 can be transmitted to compressor 31 (or series of compressors) to pressurize the remaining uncondensed gases. Condensed gasoline products, light gases such as propane and butane, and sulfur can be separated in light hydrocarbon recovery and sulfur removal system 33 and utilized as previously described.

Various changes may be made to the forms of the invention herein shown and described without departing from the true spirit of the invention or the scope of the following claims.

I claim:

1. A method for the recovery of the vaporizable constituents of a particulate hydrocarbonaceous composite such as shale, coal and tar sands from a retort chamber in the absence of air, comprising the steps of introducing the composite through an air seal into the retort chamber, comingling the composite in intimate contact with a molten heat transfer material maintained at a temperature above the vaporizing temperature of the vaporizable constituents of said particulate composite, and collecting the vaporized products above the surface of the molten heat transfer material, said step of introducing said composite through an air seal into the retort chamber further comprising the steps of passing said composite downwardly into a sealing liquid held at a level above any exit port for said composite, and conveying said composite upwardly from said liquid and into said retort chamber.

2. The method of claim 1 wherein said molten heat transfer material is a salt.

3. The method of claim 1 wherein said molten heat transfer material is a metal or alloy.

4. The method of claim 1 wherein said vaporizable constituents are recovered as liquids or gases.

5. The method of claim 4 including the step of separately collecting said liquid and said gaseous products.

6. Method of claim 1 wherein during the step of conveying said composite from said liquid into said retort chamber, said composite is conveyed upward and transported through a first chamber prior to being conveyed into said retort chamber.

7. The method of claim 6 wherein said particulate composite is heated in said first chamber to vaporize at least a portion of said vaporizable constituents.

8. A method for the recovery of the vaporizable constituents of a particulate hydrocarbonaceous composite such as shale, coal and tar sands in the absence of air, including the steps of passing the composite through a vessel including a liquid held at a level above any exit port, which liquid constitutes a seal which prevents air from travelling further with the composite, conveying the composite upwardly from said vessel into a first chamber above said liquid level, heating the composite in said first chamber to release vaporizable constituents, collecting vaporized products released in said first chamber, conveying the composite from said first chamber to a second chamber, comingling the composite in intimate contact in said second chamber with a molten heat transfer material maintained at a temperature above the vaporizing temperature of the vaporizable constituents of the particulate composite, collecting the vaporized products released in said second chamber above the surface of the molten heat transfer material, and passing said composite from said second chamber through a second seal which prevents the entry of air into said second chamber.

9. Method of claim 8 including the steps of removing any molten heat transfer material clinging to said composite after it is conveyed through said second seal, and returning said removed material to said second chamber.

10. An apparatus for the recovery of the vaporizable constituents of a particulate hydrocarbonaceous composite such as shale, coal and tar sands in the absence of air, comprising sealing means consisting of a vessel containing a liquid filled to a level above the vessel exit ports, means conveying said composite downwardly into said vessel means conveying the composite upwardly from said liquid and to a recovery retort, a molten heat transfer material filling said retort to a level above entrance and exit ports thereof, said material maintained at a temperature above the vaporizing temperature of recoverable constituents of said particulate composite, conveyor means passing into and out of said molten material for comingling the composite in intimate contact therewith, and means collecting vaporized products above the surface of said molten heat transfer material.

11. Apparatus of claim 10 including means for completely submerging said composite in said liquid and including means conveying said composite upwardly from said liquid through port means entirely below the surface of said liquid so as to provide a seal between said retort and the vessel.

12. Apparatus of claim 10 further including a first chamber disposed between said sealing means and said retort and including means for conveying said composite into said first chamber and means for collecting additional vaporized products in said first chamber.

13. Apparatus of claim 12 including means for heating said particulate composite in said first chamber to vaporize at least a portion of said vaporizable constituents.

14. Apparatus of claim 10 including conveyor means for transporting said particulate composite through said liquid.

15. Apparatus of claim 14 further including a collector disposed beneath said conveying apparatus to accummulate any of said particulate composite which falls from said conveyor means.

16. A system for the recovery of the vaporizable constituents of a particulate hydrocarbonaceous composite such as shale, coal and tar sands, in the absence of air, comprising, first and second ported product recovery chambers, sealing means comprising a liquid at a level above an exit port to said first chamber, means for conveying said composite through said liquid and upward into said first chamber, means for heating said composite in said first chamber to release parts of said vaporizable constituents, means collecting vaporized products in said first chamber, means conveying said composite from said first chamber into said second chamber, a molten heat transfer material in said second chamber maintained at a temperature above the vaporizing temperature of recoverable constituents of the particular composite, conveyor means for comingling said composite in intimate contact with said molten heat transfer material and transporting the composite into and out of said material, means collecting the vaporized products released in said second chamber above the surface of the molten heat transfer material, second sealing means for preventing the entry of air into said second chamber, and means conveying said composite from said second chamber through said second sealing means to a discharge point.

17. System of claim 16 including means for heating said composite disposed about said means conveying said composite from said first chamber to said second chamber, and cooling means disposed about said means for conveying said composite from said second chamber, said heating means and said cooling means coupled to form heat exchange means.

18. System of claim 16 including means for recovering molten heat transfer material clinging to said composite after said composite is conveyed through said second sealing means.

* * * * *